US005100122A

United States Patent [19]

Noda et al.

[11] Patent Number: 5,100,122

[45] Date of Patent: Mar. 31, 1992

[54] SHEET FEEDING DEVICE HAVING MOVABLE SHEET PLACING UNIT FOR USE IN A VARIABLE SIZE MULTIPLYING TYPE IMAGE FORMING DEVICE

[75] Inventors: Yoshiyuki Noda, Kyoto; Atsushi Narukawa; Toshihisa Matsuo, both of Yamatokooriyama, all of Japan

[73] Assignee: Sharp Kabushiki Kaisha, Osaka, Japan

[21] Appl. No.: 520,401

[22] Filed: May 8, 1990

[30] Foreign Application Priority Data

May 9, 1989 [JP] Japan ..... 1-116439

[51] Int. Cl.[5] ..... B65H 1/26

[52] U.S. Cl. ..... 271/155; 271/127; 271/145; 271/157; 271/162

[58] Field of Search ..... 271/127, 145, 147, 157, 271/158, 162, 164, 171, 241, 252–255, 265, 152–156

[56] References Cited

U.S. PATENT DOCUMENTS 4,763,891 8/1988 Kodama ..... 271/157

FOREIGN PATENT DOCUMENTS 59245 5/1981 Japan .

262735 12/1985 Japan ..... 271/145

123859 7/1989 Japan .

*Primary Examiner*—Robert P. Olszewski

*Assistant Examiner*—Boris Milef

[57] ABSTRACT

A sheet feeding device, includes a lift down sensor for detecting a rotating plate of a rotatable cassette lowered down to a planar position, a lift up sensor for detecting the rotating plate lifted up to a sheet feeding position, a lateral feed position detecting sensor for detecting the rotatable cassette situated in the lateral feeding position, a longitudinal feed position detecting sensor for detecting the rotatable cassette situated in the longitudinal feeding position, and control means for controlling the drive mechanisms of the sheet feeding device. In the rotating operation of the rotatable cassette, if the lift down sensor is not turned on, the rotating plate is lowered so as to turn on the lift down sensor, thereafter the rotatable cassette is rotated to the predetermined longitudinal or lateral feeding position, and after the lateral or longitudinal feed position detecting sensor is turned on, the rotating plate is lifted up until the lift up sensor is turned on.

8 Claims, 8 Drawing Sheets

SHEET FEEDING DEVICE HAVING MOVABLE SHEET PLACING UNIT FOR USE IN A VARIABLE SIZE MULTIPLYING TYPE IMAGE FORMING DEVICE

BACKGROUND OF THE INVENTION

1. Field of the Invention

The present invention relates to a sheet feeding device for use in a copying apparatus and a printer or the like.

2. Description of the Prior Art

In a conventional copying apparatus or a printer, there is provided a sheet feeding device for feeding a sheet of paper for printing having a plurality of sheet feeding cassettes for feeding paper of various sizes such as A3, B4, A4 and B5 sizes corresponding to a size of an original document. Referring to a way of carrying paper for printing from a sheet feeding device to e.g. a copying machine as a sheet receiving device, it is preferable from the viewpoint of sheet feeding speed to employ lateral feeding for feeding paper in a lateral direction thereof rather than to employ longitudinal feeding for feeding paper in a longitudinal direction thereof, and in the conventional copying machines, there is a kind of copying machine employing a lateral feeding also in the case of feeding paper of large size such as B4 and A3 sizes.

On the other hand, in the case that the lateral feeding is employed even when a sheet of large size such as A3 or B4 size is fed for printing, it is required to make a large-scaled photosensitive drum, sheet carrying roller and sheet carrying path provided in the copying machine so that the copying apparatus including these devices must be made large-scaled, resulting in raising the cost of the apparatus due to the large-scaled apparatus. Therefore, in general, there is employed a longitudinal feeding when sheets of a large size such as B4 and A3 sizes are fed and a lateral feeding is employed when a sheet of small size such as A4 or B5 size is fed.

However, in such a constitution as employed in a conventional apparatus, in a copying machine having a variable magnification/minification function, while it is required to provide two longitudinal sheet feeding types of cassettes B5R and A4R for feeding a small-sized sheet such as B5 and A4 sizes in a longitudinal direction of the sheet in a minification copying operation of an original document of A3 and B4 size for example, and it is also required to provide two lateral sheet feeding types of cassettes B5 and A4 for feeding a sheet of B5 and A4 sizes in a lateral direction thereof if considering the sheet feeding rate. Therefore, in order to provide various types of sheet feeding cassettes as mentioned above, it is necessary to provide a large-scaled sheet feeding device or to use a plurality of sheet feeding cassettes selecting one of the cassettes according to a size of printing sheet, resulting in that the apparatus must be made large-scaled and there is a problem that the cost thereof is increased and that the operation thereof becomes complicated.

Therefore, in order to solve the problems mentioned above, there have been previously proposed various sheet feeding devices as disclosed in the Japanese Patent Laid Open 56-59245 and in the Japanese Patent Laid Open 59-123859, in which a sheet feeding cassette for feeding a sheet of B5 size is common in use for both the cassettes B5 and B5R and another sheet feeding cassette for feeding a sheet of A4 size is common in use for both the cassettes A4 and A4R by rotating the cassettes respectively between the lateral feeding position and the longitudinal feeding position.

However, in the conventional sheet feeding device mentioned above, there is not considered a relationship between a rise/fall operation of a rotating plate for lifting the printing sheets and a rotating operation of a rotating cassette and there is a problem that the sheet disposed on the rotating plate interferes with other member of the apparatus when the rotating cassette is rotated, so that the rotating cassette can not be rotated properly.

SUMMARY OF THE INVENTION

In order to solve the problem mentioned above, the present invention has been made and has its essential object to provide a sheet feeding device capable of rotating a rotating cassette with accuracy.

According to a feature of the present invention, a sheet feeding device in which a rotating cassette having a rotating plate pivotally rotatable in a vertical direction with a printing sheet disposed thereon can be rotated by a cassette rotating motor between a longitudinal feeding position where the printing sheet is longitudinally fed and a lateral feeding position where the printing sheet is laterally fed to a sheet receiving apparatus, and a lift member for lifting and rotating the rotating plate of the rotating cassette upward is driven by a rotating plate driving motor, comprises:

a lift down sensor for detecting that the rotating plate of the rotating cassette is lowered down to the bottom wall of the cassette case;

a lift up sensor for detecting that the rotating plate is lifted up to a position capable of feeding a printing sheet;

a lateral feed position detecting sensor for detecting that the rotating cassette is situated in the lateral feeding position;

a longitudinal feed position detecting sensor for detecting that the rotating cassette is situated in the longitudinal feeding position; and control means for controlling the drive of the respective motors in such a manner that, when in the rotating operation of the rotating cassette, in case the lift down sensor is not turned on, the rotating plate driving motor is so driven that the rotating plate is lowered so as to turn on the lift down sensor, and after the lift down sensor is turned on, the cassette rotating motor is so driven that the rotating cassette is rotated to a predetermined longitudinal or lateral feeding position where the lateral feed position detecting sensor or longitudinal feed position detecting sensor is turned on, and after the lateral or longitudinal feed position detecting sensor is turned on, the rotating plate driving motor is so driven that the rotating plate is lifted up until the lift up sensor is turned on.

According to another feature of the present invention, a sheet feeding device in which a rotating cassette having a rotating plate pivotally rotatable in a vertical direction with a printing sheet disposed thereon rotatable between a longitudinal feeding position where the printing sheet is longitudinally fed and a lateral feeding position where the printing sheet is laterally fed to a sheet receiving apparatus and a lift member for lifting and rotating the rotating plate of the rotating cassette upward are driven by one driving motor, comprises:

a lift down sensor for detecting that the rotating plate of the rotating cassette is lowered down to the bottom wall of the cassette case;

a lift up sensor for detecting that the rotating plate is lifted up to a position capable of feeding the printing sheet;

a lateral feed position detecting sensor for detecting that the rotating cassette is situated in the lateral feeding position;

a longitudinal feed position detecting sensor for detecting that the rotating cassette is situated in the longitudinal feeding position;

a first drive shaft clutch means which is provided on a first drive force transmission path for driving the rotating cassette so as to switch the drive force transmission on this path on and off;

a second drive shaft clutch means which is provided on a second drive force transmission path for driving the lift member so as to switch the drive force transmission on this path on and off;

control means for controlling the drive of the motor by which, when the rotating cassette is rotated, in case the lift down sensor is not turned on, the second drive shaft clutch means is engaged and the first drive shaft clutch means is released, thereafter the motor is so driven that the rotating plate is lowered down to the bottom wall of the cassette case so as to turn on the lift down sensor, and after the lift down sensor is turned on, the second drive shaft clutch means is released and the first drive shaft clutch means is engaged and the motor is so driven that the rotating cassette is rotated to a predetermined longitudinal or lateral feeding position where the lateral feed position detecting sensor or the longitudinal feed position detecting sensor is turned on, and after the lateral feed position detecting sensor or the longitudinal feed position detecting sensor is turned on, if the lift up sensor is not turned on, the second drive shaft clutch means is engaged and the first drive shaft clutch means is released, thereafter the motor is so driven that the rotating plate is lifted up until the lift up sensor is turned on.

Thus, according to the first feature of the present invention, when the rotating cassette is rotated, the control means judges whether or not the lift down sensor detects that the rotating plate of the rotating cassette is lowered down to the bottom position, in other words, whether or not the lift down sensor is turned on, and in case the lift down sensor is off, the rotating plate driving motor is so driven that the rotating plate is lowered down so as to turn on the lift down sensor. After the lift down sensor is turned on, the cassette rotating motor is so driven that the rotating cassette is rotated to a predetermined longitudinal or lateral feeding position where the lateral feed position detecting sensor or the longitudinal feed position detecting sensor is turned on. Subsequently, the lateral feed position detecting sensor or the longitudinal feed position detecting sensor is turned on and the rotating cassette is situated in the predetermined feeding position, thereafter the rotating plate driving motor is so driven that the rotating plate is lifted up until the lift up sensor is turned on.

As described above, in the sheet feeding device according to the present invention, since the rotating cassette is rotated under the condition that the rotating plate is lowered down to the bottom position, it is prevented that the printing sheet on the rotating plate interferes with another means, so that the rotating cassette can be accurately rotated.

According to the second feature of the present invention, when the rotating cassette is rotated, if the lift down sensor is not turned on, the control means controls the rotating plate drive shaft clutch to be engaged and controls the rotating cassette drive shaft clutch to be released, thereafter the motor is so driven that the rotating plate is lowered down so as to turn on the lift down sensor. Subsequently, after the lift down sensor is turned on, the rotating plate drive shaft clutch is released and the rotating cassette drive shaft clutch is engaged and the motor is so driven that the rotating cassette is rotated to the predetermined longitudinal or lateral feeding position where the lateral feed position detecting sensor or the longitudinal feed position detecting sensor is turned on. And after the lateral feed position detecting sensor or the longitudinal feed position detecting sensor is turned on, in case the lift up sensor is not turned on, the rotating plate drive shaft clutch is engaged and the rotating cassette drive shaft clutch is released, thereafter the motor is so driven that the rotating plate is lifted up until the lift up sensor is turned on.

As described above, in this case, since the rotating cassette and the lift member are not driven at the same timing, both the rotating cassette and the lift member are driven by one motor, whereby the cost of the copying apparatus can be lowered. Moreover, similar to the first feature of the present invention, since the rotating cassette is rotated under the condition that the rotating plate is lowered down to the bottom position, it is prevented that the printing sheet on the rotating plate interferes with another means, so that the rotating cassette can be accurately rotated.

The features of the present invention which are believed to be novel are set forth with particularity in the appended claims. The present invention together with further objects and advantages thereof may best be understood with reference to the following detailed description, taken in conjunction with the accompanying drawings.

BRIEF DESCRIPTION OF THE DRAWINGS

FIGS. 1 through 5 show an embodiment of the present invention, wherein

FIG. 1 is a schematic view showing an entire part of a copying apparatus provided with a sheet feeding device;

FIG. 2 is a perspective view showing a condition of a second rotating cassette unit shown in FIG. 1 being drawn out;

FIG. 3(*a*) is a longitudinal sectional view of first and second rotating cassette units shown in FIG. 1;

FIG. 3(*b*) is a plan view of the rotating cassette units shown in FIG. 3(*a*);

FIG. 4 is a block diagram showing a control unit; and

FIG. 5 is a flow chart showing a control operation of the sheet feeding device.

FIGS. 6 through 8 show another embodiment of the present invention, wherein FIG. 6 is a plan view of first and second rotating cassette units;

FIG. 7 is a block diagram showing a control unit, and

FIG. 8 is a flow chart showing a control operation of the sheet feeding device.

DETAILED DESCRIPTION OF THE PREFERRED EMBODIMENTS

Before the description proceeds, it is noted that the present invention is explained with reference to examples of a sheet feeding device for feeding four kinds of printing paper sizes such as B5, A4, B4 and A3 sizes used in a copying machine.

EMBODIMENT 1

A first embodiment of the sheet feeding device according to the present invention is explained with reference to FIGS. 1 through 5.

Figure 1:
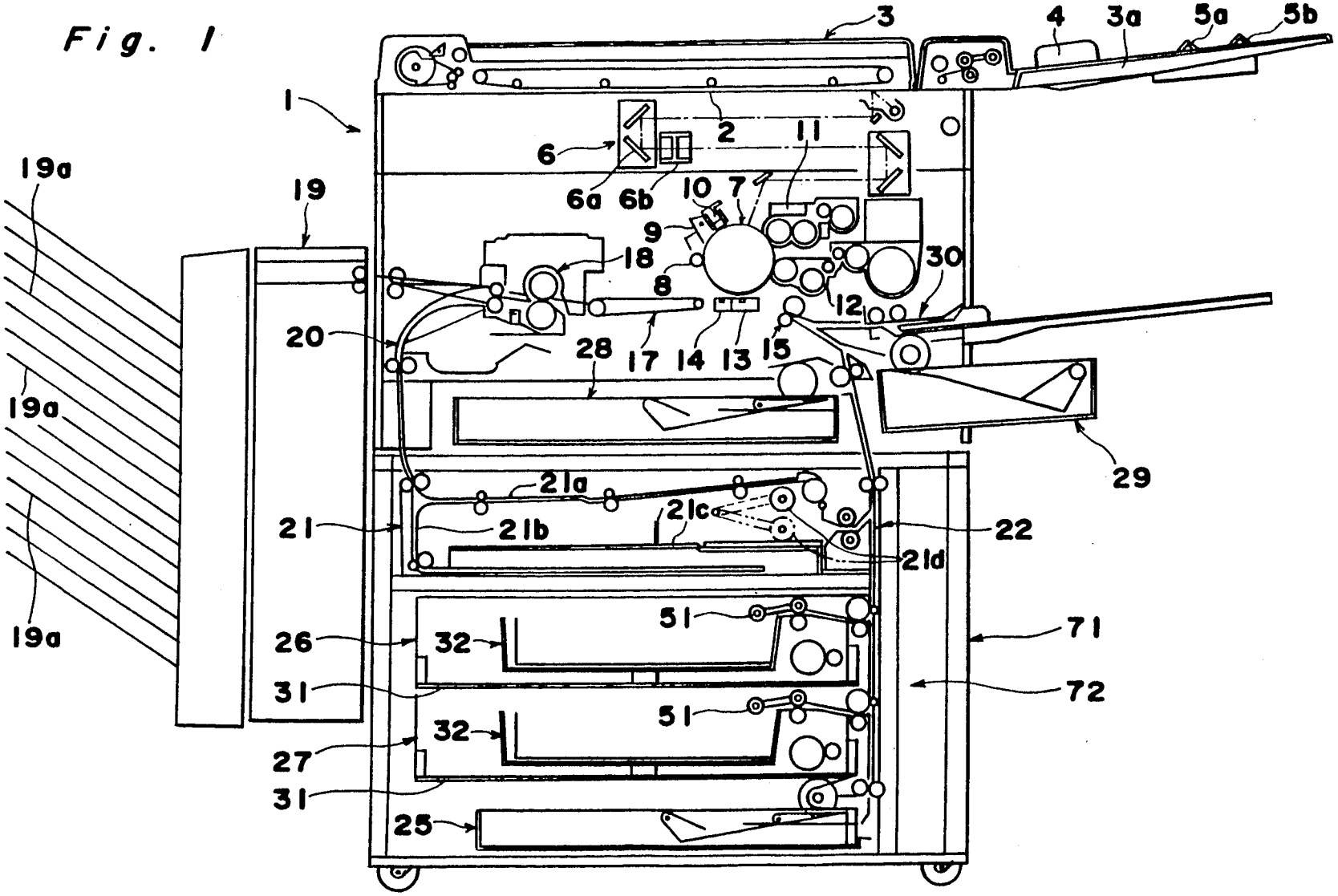
Figure 2:
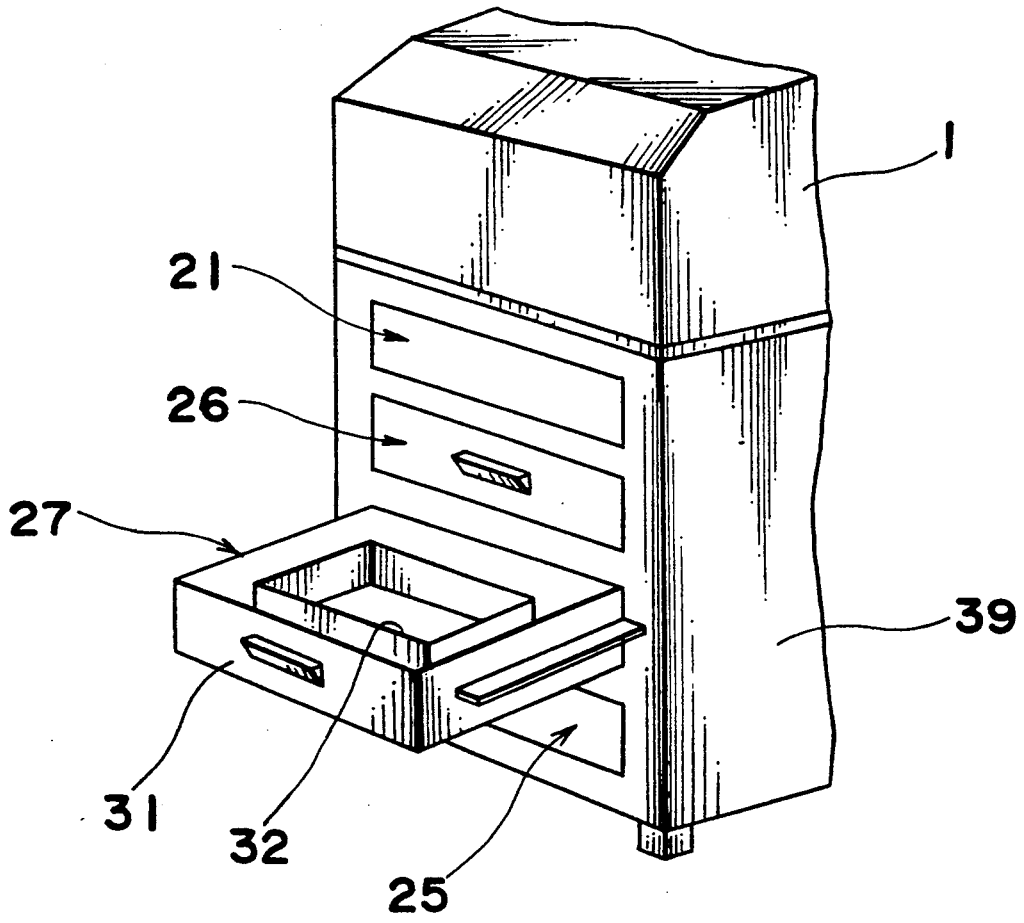

As shown in FIG. 1, a copying apparatus comprises a copying machine 1 as a sheet receiving device, a desk portion 71 provided under the copying machine 1, a sorter portion 19 provided on a sheet exhauster side of the copying machine 1 and an automatic document feeding device (referred to as ADF hereinafter) 3 provided on the top portion of the copying machine 1. In the desk portion 71, there is provided a sheet feeding device 72 which comprises a dual side compound unit 21, a first rotating cassette unit 26, a second rotating cassette unit 27 and a third fixed cassette 25 in turn from the upper to lower portion thereof. In each of the first and second rotating cassette units 26 and 27, there is provided a rotatable cassette 32 in an outer case 31.

The ADF 3 is provided on an original table glass 2 having a generally rectangular flat shape made of a transparent glass plate provide do the top portion of the copying machine 1. The ADF 3 carries an original document (not shown) disposed on an original placing platform 3*a* to a predetermined position on the original table glass 2 according to the size and the feeding direction of the original document and exhausts the original document to the outside after completion of a copying operation. Moreover, the ADF 3 has a function that, in the case of carrying out a dual-sided copying operation, the original document is reversed and carried to the predetermined position on the original table glass 2 once more and the original document is discharged after completion of the dual-sided copying operation.

On the original placing platform 3*a*, there are provided longitudinal size detecting switches 5*a* and 5*b* for detecting the size of the original document in the feeding direction and a guide member 4 for regulating both sides of the original document in the lateral direction thereof. On the guide member 4, there is provided a lateral size detecting switch (not shown) for detecting the lateral size of the original document, so that an original document size detecting device is configured by providing there switches.

There is provided an optical system 6 composed of a plurality of reflection mirrors 6*a* and lenses 6*b* below the original table glass 2. The optical system 6 has not only a fundamental function of transferring the reflection light beam reflected by the original document to a photosensitive drum 7 but also a function of copying in a variable magnification and minification rate, thereby constituting a mechanism capable of not only a normal copying operation of an equal magnification/minification rate but also a variable magnification/minification copying operation.

In the peripheral portion of the photosensitive drum 7, there are provided a cleaner 8 for cleaning the surface of the photosensitive drum 7, a charge removal charger 9 for removing remaining toner, an electrifier charger 10, a developing device 11 containing toner for a color copying operation and a developing device 12 containing black toner, so that a series of operations, i.e., charge→exposure→development→removal of remaining toner→removal of charge, with respect to the photosensitive drum 7 are carried out by providing the above means 6 through 12.

There are provide a transfer charger 13 and a separation charger 14 below the photosensitive drum 7, so that an electrostatic latent image of toner formed on the surface of the photosensitive drum 7 is transferred to a sheet feed onto the photosensitive drum 7 by the transfer charger 13 and the sheet having the electrostatic latent image transferred thereon is separated form the photosensitive drum 7 by the separation charger 14. The separated sheet is carried to a fixing unit 18 by a carrying belt 17 and the electrostatic latent image of toner transferred on the sheet is fixed onto the sheet by applying heat and pressure in the fixing unit 18.

The sheet having the toner image fixed thereon through the fixing unit 18 is normally fed out onto exhaust trays 19*a* through the sorter portion 19, but in the case of carrying out a dual-sided copying operation or compound copying operation, the sheet is sent to the dual-sided compound unit 21 in the desk portion 71 through a sheet feed back path 20. In the case of dual-sided copying operation, the sheet is reversely disposed on an intermediate tray 21*c* through a first carrying path 21*a* in the dual-sided compound unit 21, thereafter the sheet is fed out to the sheet carrying path 22 by a feeding roller 21*d*. On the other hand, in the case of the compound copying operation, the sheet is sent to a second carrying path 21*b* in the dual-sided compound unit 21 and the rear edge of the sheet is detected in the second carrying path 21*b*, thereafter the sheet is fed out to the intermediate tray 21*c* through the first carrying path 21*a* with it back and forth reversed so as to be disposed reversely on the intermediate tray 21*c*, thereafter the sheet is fed out to the sheet carrying path 12 by a feeding roller 21*d*.

The sheet carrying path 22 is extended to a neighborhood of the photosensitive drum 7 and at the upper end portion of the sheet carrying path 22 there is provided a paper stop roller 15 for taking the timings of the rotation of the photosensitive drum 7 and of the sheet feeding operation. The sheet carrying path 22 is coupled with a plurality of sheet feeding means through which the sheet is appropriately fed to a sheet receiving apparatus. Briefly, to the sheet carrying paths, there are provided and connected a manual sheet feeding unit 30, a first fixed cassette 29 having a capacity of storing 500 sheets of paper, a second fixed cassette 28 having a capacity of storing 250 sheets of paper, a dual-sided compound unit 21, a first rotating cassette unit 26, a second rotating cassette unit 27 and a third fixed cassette 25 having a capacity of storing 250 sheets of paper. The above fixed cassettes 29, 28 and 25 and the rotating cassette units 26 and 27 are detachably provided in the desk portion 71 of the copying apparatus.

Figure 3A:
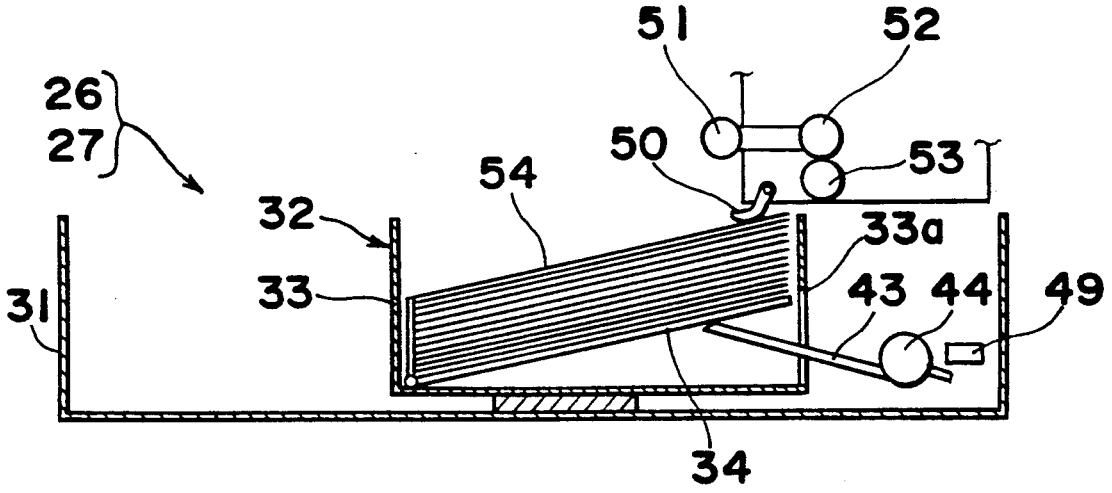
Figure 3B:
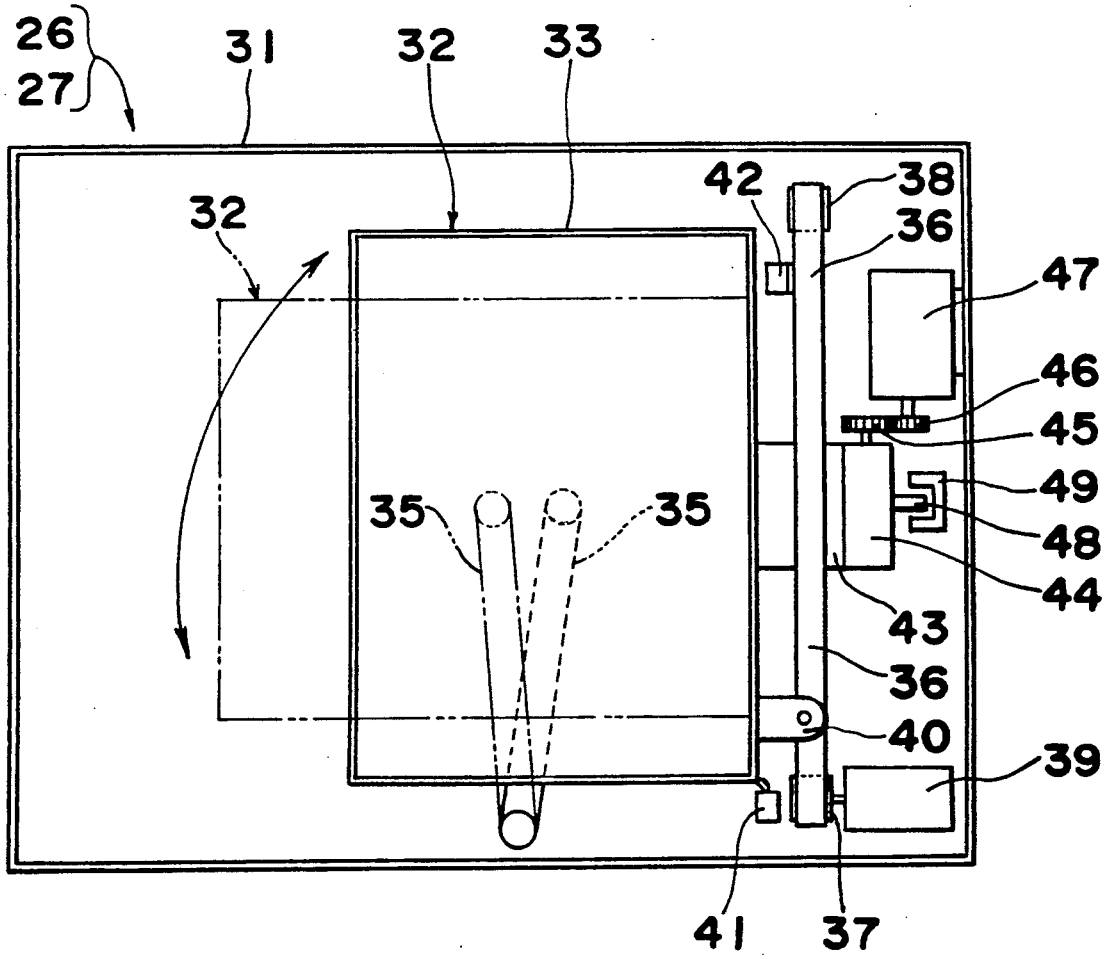

As shown in FIGS. 3(*a*) and 3(*b*), each of the first and second rotating cassette units 26 and 27 comprises an outer case 31 and a rotating cassette 32 accommodating paper 54 of a predetermined size provided in the outer case 31. The rotating cassette 32 is composed of a cassette case 33 of generally rectangular shape and a rotating plate 34 provided in the cassette case 33 for appropriately lifting the paper 54 in accordance with the decrement of the paper. The rotating plate 34 is so constituted that, when the rotating cassette 32 is situated in the lateral feeding position for feeding the paper 54 in the lateral direction thereof or situated in the longitudinal feeding position for feeding the paper 54 in the longitudinal direction thereof, the rotating plate 34 can be pivotally rotated around its rotation axis fixed at the lower edge portion of the paper 54 opposite to the feed out edge portion thereof on the bottom wall of the cassette case 33. One end portion of an arm plate 35 is pivotally attached to a central portion of the underside of the bottom wall of the cassette case 33 and the other end portion of the arm plate 35 is rotatably attached to a middle front portion of the bottom wall of the outer case 31 adjacent to the front side wall of the outer case 31.

The cassette case 33 is connected to an endless belt 36 through a connecting member 40 which is attached onto the belt 36, and a neighborhood of one corner of the cassette case 33 is rotatably connected to the connecting member 40. The belt 36 is wound round over pulleys 37 and 38 and arranged in parallel to the side edge of the feed out portion of the paper 54 on the outer case 31 in the direction perpendicular to the feed out direction of the paper. The driving shaft of a cassette rotating motor 39 is coupled with the pulley 37. In the arrangement as described above, when the cassette rotating motor 39 is driven, the rotating cassette 32 is rotated to be situated form the lateral feeding position shown by solid lines t the longitudinal feeding position shown by two-dotted lines as shown in FIG. 3(*b*) or rotated in a reversed manner. On a right front portion of the bottom wall of the outer case 31 adjacent to the pulley 37, there is provided a lateral feed position detecting sensor 41 which is switched on when the rotating cassette 32 is set in the lateral feeding position, and on a right rear portion of the bottom wall of the outer case 31 adjacent to the pulley 38, there is provided a longitudinal feed position detecting sensor 42 which is switched on when the rotating cassette 32 is set in the longitudinal feeding position.

Across a side wall of the cassette case 33 in the feeding out portion of the paper, there is provided a lift plate 43 in the feeding out direction for lifting the rotating plate 34 upward. The top end portion of the lift plate 43 is inserted into a space above the bottom wall of the cassette case 33 under the rotating plate 34 through an opening portion 33*a* defined in the side wall of the cassette case 33 in the feeding out portion of the paper so as to lift and pivotally rotate the rotating plate 34. The lift plate 43 is extended form a rotating pivot 44 which is coupled with a driving shaft of a rotating plate driving motor 47 through a pair of engaged gears 45 and 46. There is provided a detecting projection 48 on the rotating shaft 44 in the opposite direction to the lift plate 43 and in the neighborhood adjacent to the detecting projection 48 there is provided a lift down sensor 49 which is turned on when the lift plate 43 is lowered down onto the bottom wall of the cassette case 33.

Moreover, there are provided a lift up sensor 50 and a lead-out roller 51. The lift up sensor 50 is turned on by the paper 54 disposed on the rotating plate 34 when the rotating plate 34 is pivotally rotated upward by the lift plate 43. The lead-out roller 51 is lowered onto the paper 54 by a drive such as a solenoid (not shown) when the paper 54 is fed out of the rotating cassette 32. In a paper feed out direction of the lead-out roller 51, there are provided a paper feeding roller 52 for feeding the paper 54 to the paper carrying path 22 and a reversing roller 53 for preventing a double sheet feeding of the paper 54, wherein the paper feeding roller 52 is in contact with the reversing roller 53. The lateral feed position detecting sensor 41, longitudinal feed position detecting sensor 42, lift down sensor 49 and lift up sensor 50 can be made by using a contact type switch or photo-interrupter.

Figure 4:
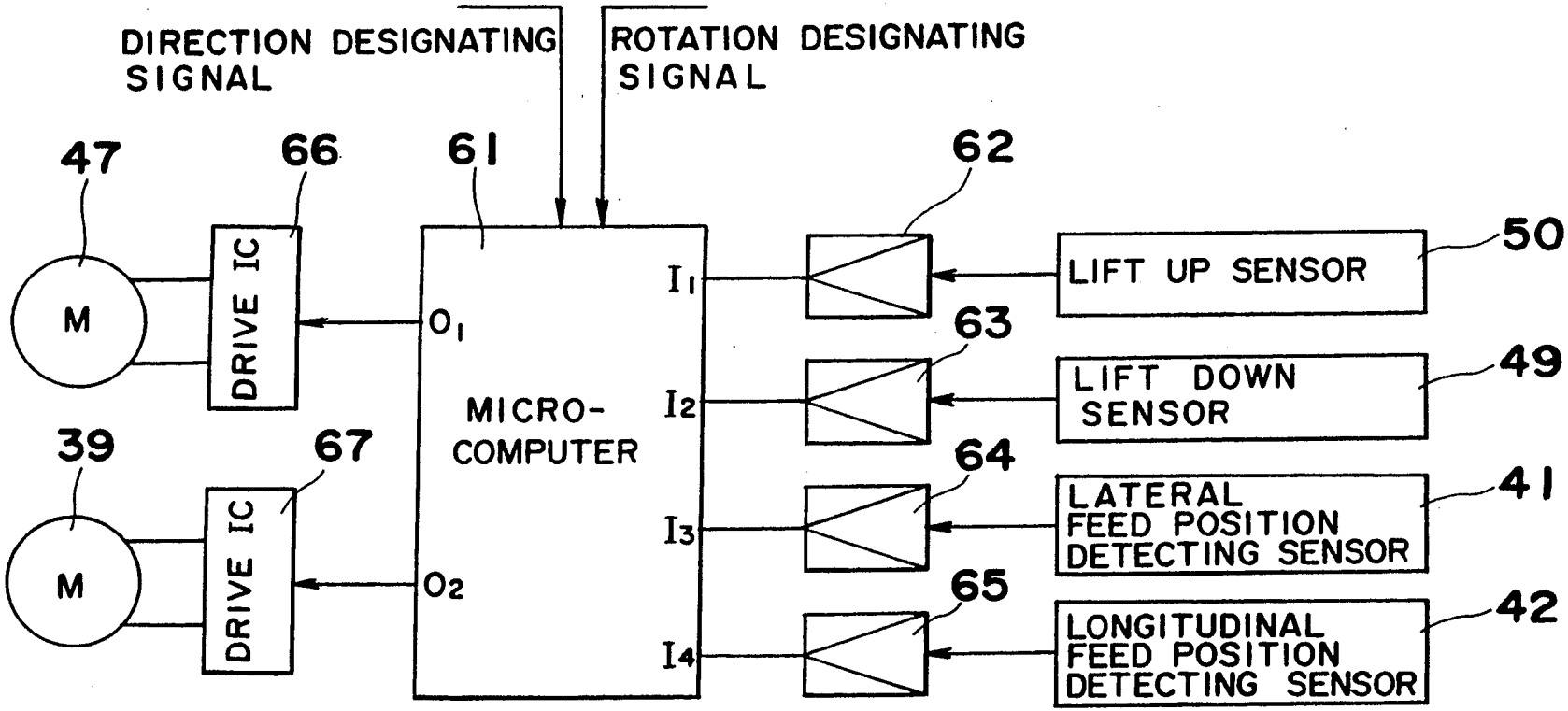

As shown in FIG. 4, the sheet feeding device 72 comprises microcomputer 61 for controlling the drive mechanisms of the sheet feeding device 72. The output signals of the lift up sensor 50, lift down sensor 49, lateral feed position detecting sensor 41 and longitudinal feed position detecting sensor 42 are entered to the input ports $I_1$ to $I_4$ of the microcomputer 61 through amplifiers 62 to 65 respectively. The control signals output from the output ports $O_1$ and $O_2$ of the microcomputer 61 are transmitted to the rotating plate driving motor 47 and cassette rotating motor 39 through drive integrated circuits (referred to as drive IC hereinafter) 66 and 67 respectively. The drive ICs 66 and 67 are respectively so constituted as to forward rotate or reversely rotate the rotating plate driving motor 47 and cassette rotating motor 39 based on the control signals output from the microcomputer 61. Upon operating an input key (not shown) arranged in an operation panel provided in the front portion of the copying machine 1, a rotation designating signal is applied to the microcomputer 61 for designating one of the rotating cassettes 32 and 32 provided in the first and second rotating cassette units 26 and 27 and a direction designating signal is applied to the microcomputer 61 for selecting the longitudinal feeding position or lateral feeding position for setting the rotating cassette 32. The microcomputer 61 stores the data of the sizes of the paper 54 disposed in the respective fixed cassettes 29, 28 and 25 and in the rotating cassettes 32 and 32 in the rotating cassette units 26 and 27 and stores the data of longitudinal and lateral feeding directions of the paper 54.

Figure 5:
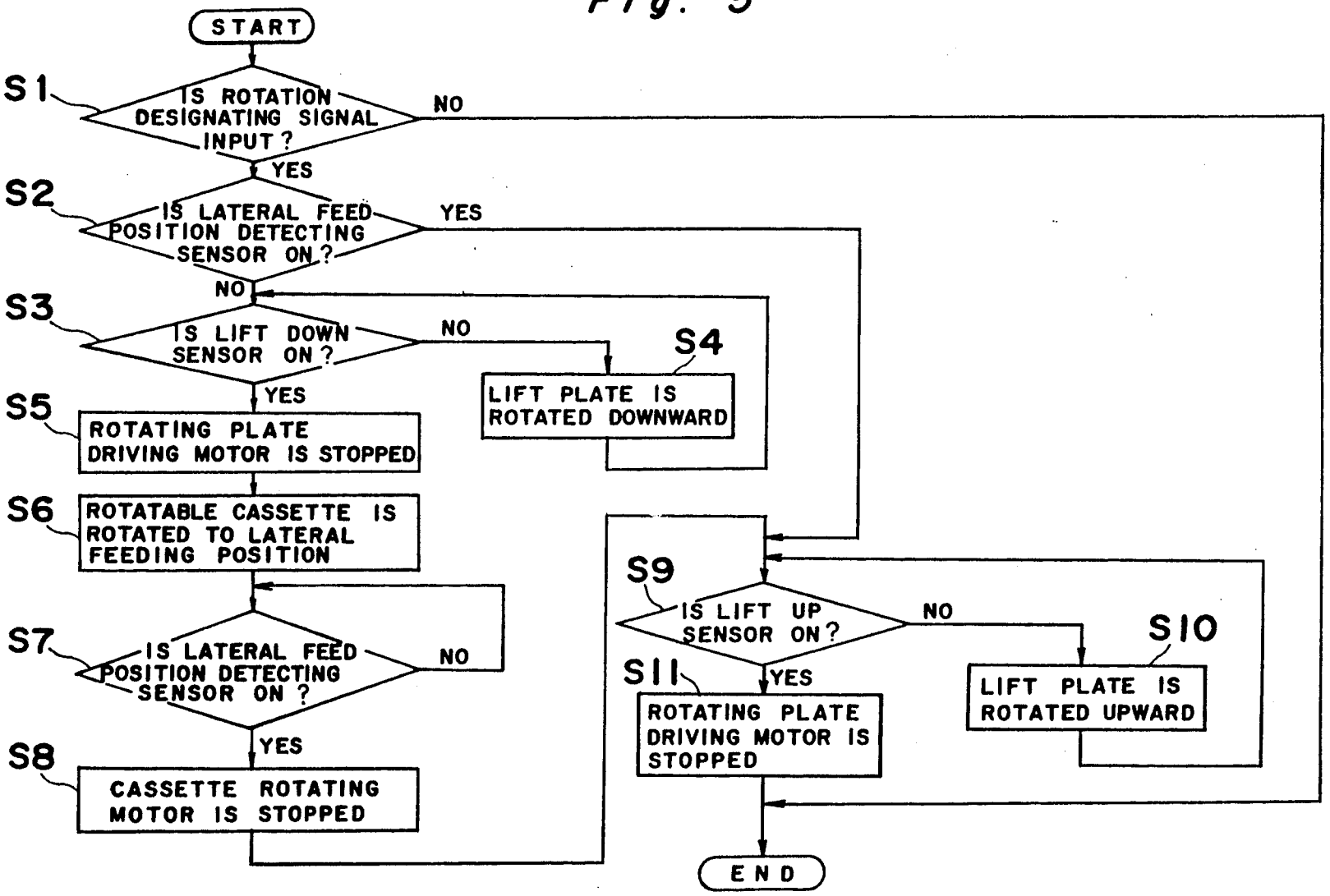

In the arrangement of the control means as described above, under the condition that the rotation designating signal and direction designating signal are input to the microcomputer 61, the control operation of the sheet feeding device 72 is explained with reference to FIG. 5.

It is assumed that the paper of e.g. A4 size for feed in the lateral direction is selected by operating the input key provided on the operation panel and the rotating cassette 32 in the first rotating cassette unit 26 accommodating the paper 54 of A4 size is selected as the paper feeding cassette. In this case, the direction designating signal designates the lateral feeding position for setting the rotating cassette 32 and the rotation designating signal designates the rotation of the rotating cassette 32 in the first rotating cassette unit 26.

The microcomputer 61 judges in the first step S1 whether or not the rotation designating signal is entered to the microcomputer 61, and in case there is not entered a rotation designating signal, the program goes to the END. In case the rotation designating signal is entered, it is judges in step S2 whether or not the rotation cassette 32 of the first rotating cassette unit 26 is set in the lateral feeding position for setting the paper of A4 size (referred to as A4 position), in other words, whether or not the lateral feeding position detecting sensor 41 is turned on, and in case the lateral feeding position detecting sensor 41 is turned on, the program goes to step S9. In case the lateral feeding position detecting sensor 41 is not turned on in step S2, it is judged in step S3 whether or not the rotating plate 34 is lowered down onto the bottom wall of the cassette case 33 which is the lowest position of the rotating plate 34, in other words, whether or not the lift down sensor 49 is turned on. In case the lift down sensor 49 is not turned on, the rotating plate driving motor 47 is so driven that the lift plate 43 is rotated downward in the step S4 and program does to the step S3. In case the lift down sensor 49 is turned on in step S3, the rotating plate driving motor 47 is stopped in step S5. In this state, the rotating plate 34 is lowered down on the bottom wall of the cassette case 33 (i.e., the lowest position) and the paper disposed on the rotating plate 34 is situated in the lowest position.

Subsequently, in step S6, the cassette rotating motor 39 is so driven that the rotation cassette 32 is set in the lateral feeding position (i.e., A4 position). And it is judged in the next step S7 whether or not the lateral feed position detecting sensor 41 is turned on, and in case the lateral feed position detecting sensor 41 is turned on, the cassette rotating motor 39 is stopped in step S8. Subsequently, it is judged in the next step S9 whether or not the lift up sensor 50 is turned on, and in case the lift up sensor 50 is not turned on, the rotating plate driving motor 47 is so driven that the lift plate 43 is rotated upward in step S10 and program goes to the step S9. In case the lift up sensor 50 is turned on in step S9, the rotating plate driving motor 47 is stopped in step S11 and the rotation of the rotating cassette 32 is completed.

In the control operation as described above, when the rotating cassette 32 is rotated, after it is detected that the rotating plate 34 of the rotating cassette 32 falls down onto the bottom wall of the cassette case 33, in other words, after it is detected that the paper 54 disposed on the rotating plate 34 is lowered down to the bottom position, the rotating cassette 32 is rotated to be set in the desired position, therefore, the paper 54 can be prevented from interfering with other means during the rotation of the rotating cassette 32, so that the rotating cassette 32 can be accurately rotated to be set in the desired position. In the first embodiment as described above, although the explanation is made about the rotating operation of the rotating cassette 32 to be set in the lateral feeding position, also in the rotating operation of the rotating cassette 32 to be set in the longitudinal feeding position, the relation between the rotation of he rotating cassette 32 and the movement of the lift plate member 43 can be similarly obtained.

EMBODIMENT 2

A second embodiment of the present invention is explained with reference to FIGS. 6 through 8, and it is noted that like parts are designated by like reference numerals throughout the drawings, thereby omitting the explanation thereof.

Figure 6:
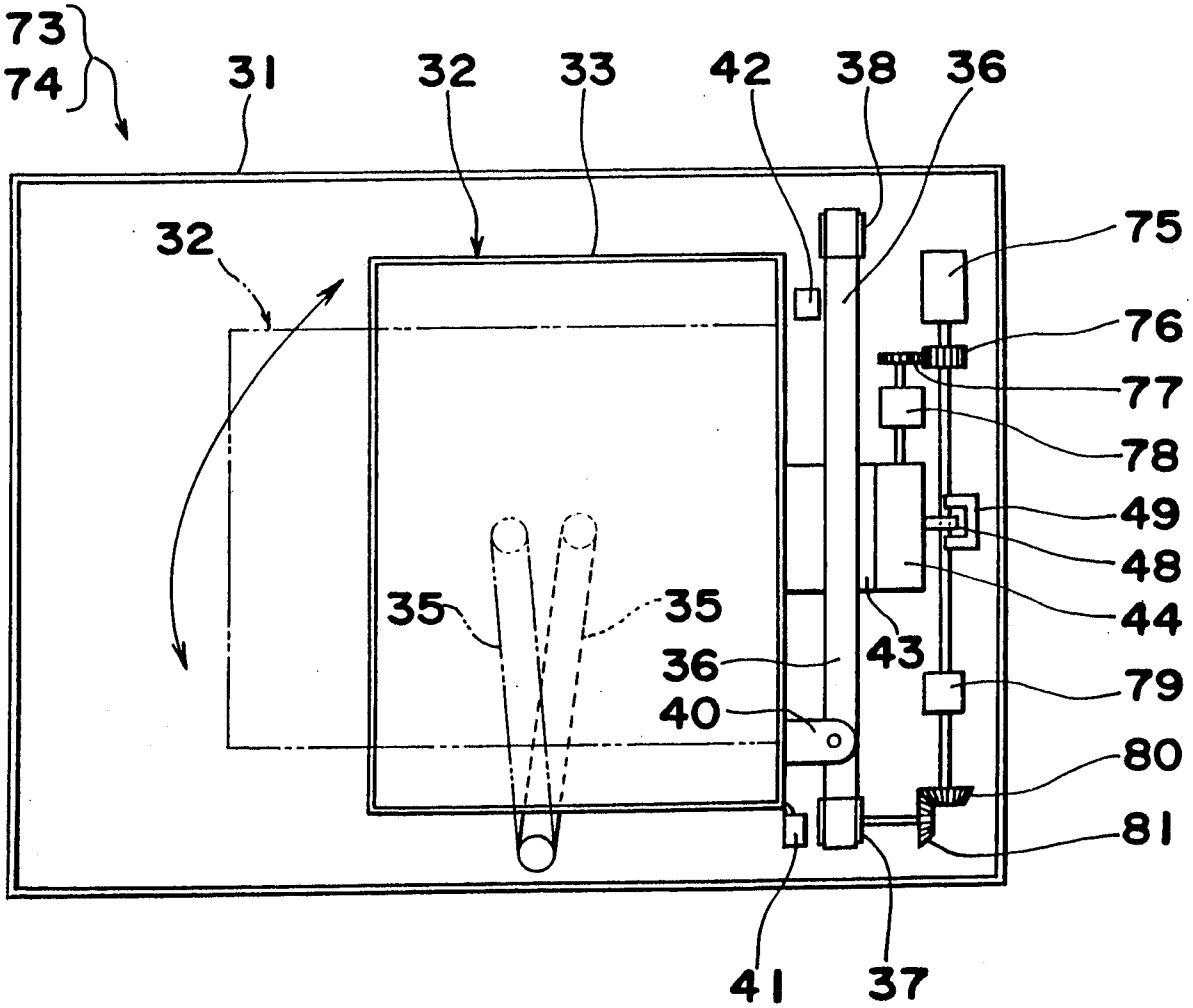

In the second embodiment of the sheet feeding device according to the present invention, as shown in FIG. 6, each of the first and second rotating cassette units 73 and 74 corresponding to the first and second rotating cassette units 26 and 27 of the first embodiment comprises one motor 75 which is in common use for both as the cassette rotating motor 39 and the rotating plate driving motor 47. The rotating axis of the motor 75 is coincident with the axis of a gear 76, axis of a rotating cassette drive shaft clutch 79 and with the axis of a gear 80 and the rotating shaft of the motor 75 is coupled with the rotating pivot 44 through the gears 76 and 77 and through a rotating plate drive shaft clutch 78 and is also coupled with the pulley 37 through a rotating cassette drive shaft clutch 79 and through gears 80 and 81.

Figure 7:
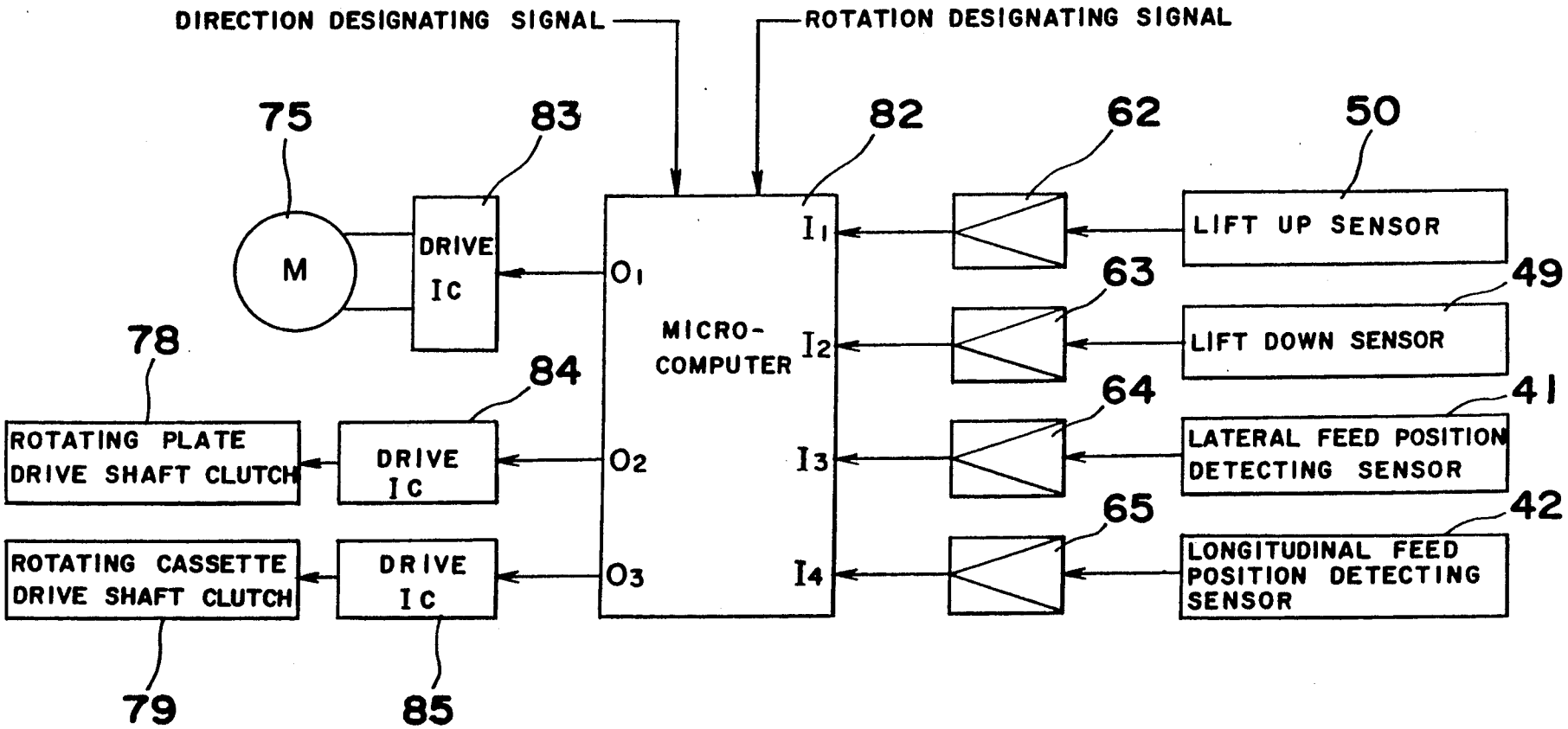
Figure 8:
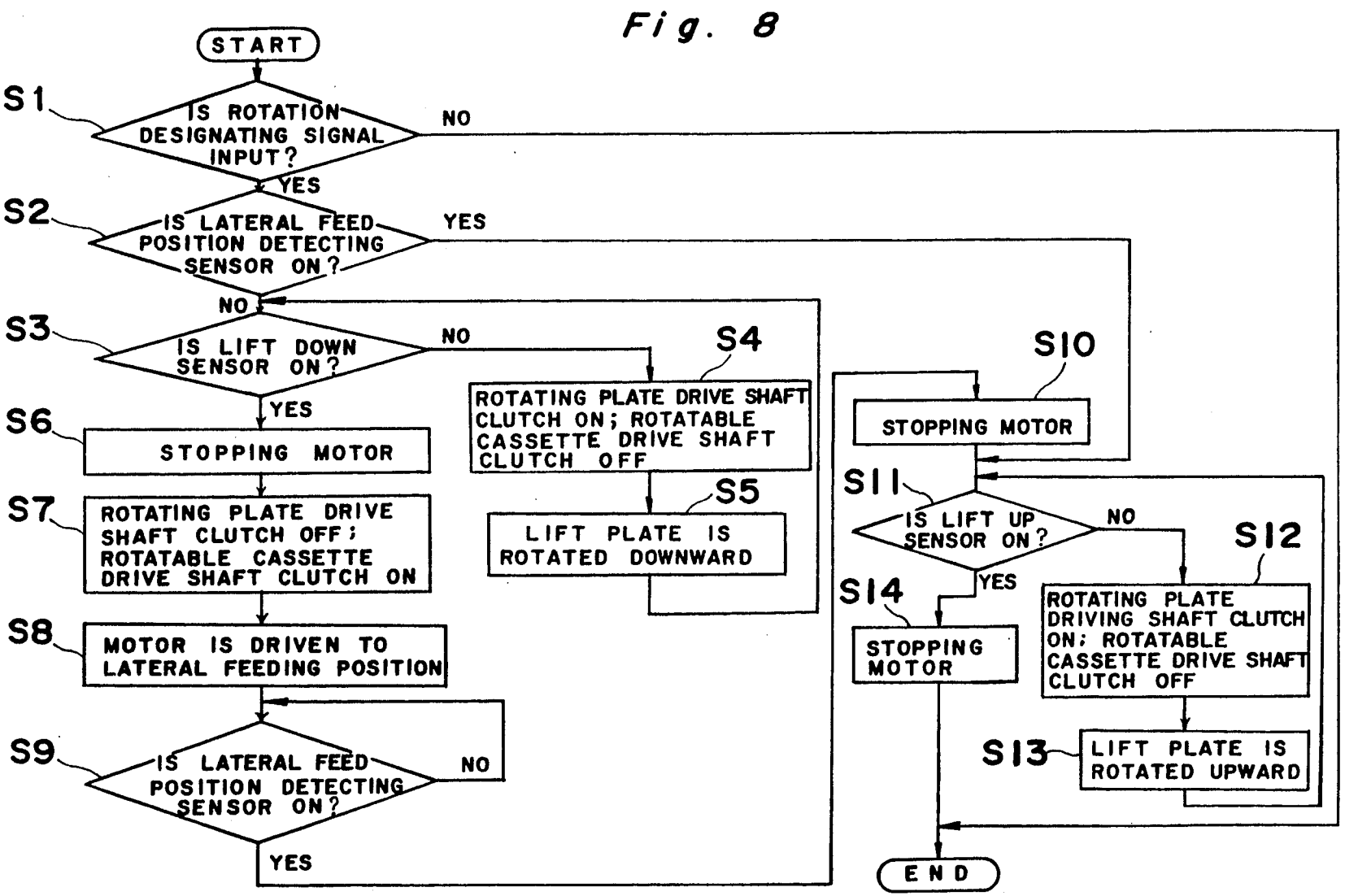

As shown in FIG. 7, the motor 75 is connected to an output port $O_1$ of a microcomputer 82 through an IC driver 83. And the drive shaft clutches 78 and 79 are connected to the output ports $O_2$ and $O_3$ of the microcomputer 82 through IC drivers 84 and 85 respectively and other units are connected similarly to those shown in FIG. 4 of the first embodiment, so that the control of the microcomputer 82 is carried out as shown in FIG. 8.

In the arrangement mentioned above, the operation of the sheet feeding device is explained with reference to the flow chart shown in FIG. 8.

It is assumed that the paper 54 of e.g. A4 size for feed in a lateral direction is selected by operating an input key on the operation panel and that the rotating cassette 32 in the first rotating cassette unit 73 accommodating the paper 54 of A4 size is selected. At this time, the direction designating signal designates the lateral feeding position of the rotating cassette 32 and the rotation designating signal designates the rotation of the rotating cassette 32 in the first rotating cassette unit 73.

First in step S1, it is judged whether or not the rotation designating signal is entered in the microcomputer 82, and in case there is not entered a rotation designating signal in the microcomputer 82, the program goes to END. In case there is entered a rotation designating signal in step S1, it is judged in step S2 whether or not the lateral feed position detecting sensor 41 is being turned on, and in case the lateral feed position detecting sensor 41 is turned on, the program goes to step S11. In case the lateral feed position detecting sensor 41 is not turned on in step S2, it is judged in step S3 whether or not the lift down sensor 49 is turned on, and in case the lift down sensor 49 is not turned on, the rotating plate drive shaft clutch 78 is switched on and the rotating cassette drive shaft clutch 79 is switched off in step S4. Subsequently in step S5, the motor 75 is so driven that the lift plate 43 is rotated downward and program goes back to the step S3. In case the lift down sensor 49 is turned on in step S3, the program goes to step S6 and the motor 75 is stopped. In this state, the rotating plate 34 falls down onto the bottom wall of the cassette case 33 and the paper 54 on the rotating plate 34 is lowered to the bottom position.

Subsequently in step S7, the rotating plate drive shaft clutch 78 is turned off and the rotating cassette drive shaft clutch 79 is turned on and in the next step S8 the motor 75 is so driven that the rotating cassette 32 is set in the lateral feeding position (i.e., A4 position). It is judged in the next step S9 whether or not the lateral feed position detecting sensor 41 is turned on, and in case the lateral feed position detecting sensor 41 is turned on, the motor 75 is stopped in the S10. Subsequently in step S11, it is judged whether or not the lift up sensor 50 is turned on, and in case the lift up sensor 50 is not turned on, the rotating plate drive shaft clutch 78 is turned on and the rotating cassette drive shaft clutch 79 is turned off in step S12 and the motor 75 is so driven that the lift plate 43 is rotated upward in step S13 and the program goes back to step S11. If the lift up sensor 50 is turned on in step S11, the program goes to step S14 and the motor 75 is stopped and the rotating operation of the rotating cassette 32 is ended.

According to the first embodiment of the present invention, when the rotating cassette is rotated, the control means judges whether or not the lift down sensor detects that the rotating plate of the rotating cassette falls down to the bottom position, in other words, whether or not the lift down sensor is turned on, and in case the lift down sensor is not turned on, the rotating plate driving motor is so driven that the rotating plate falls down so as to turn on the lift down sensor. And after the lift down sensor is turned on, the cassette rotating motor is so driven that the rotating cassette is rotated to be set in a predetermined longitudinal or lateral feeding position where the lateral feed position detecting sensor or the longitudinal feed position detecting sensor is turned on. Subsequently, the lateral feed position detecting sensor or the longitudinal feed position detecting sensor is turned on and the rotating cassette is situated in the predetermined feeding position, thereafter the rotating plate driving motor is so driven that the rotating plate is lifted up until the lift up sensor is turned on.

Therefore, in the sheet feeding device according to the first embodiment, since the rotating cassette is rotated under the condition that the rotating plate falls down to the bottom position, it is prevented that the sheet on the rotating plate interferes with other means, so that the rotating cassette can be accurately rotated to be set in a desired position, so that the reliability of the device can be improved.

According to the second embodiment of the present invention, when the rotating cassette is rotated, if the lift down sensor is not turned on, the control means controls the rotating plate drive shaft clutch to be engaged and controls the rotating cassette drive shaft clutch to be released, thereafter the motor is so driven that the rotating plate falls down so as to turn on the lift down sensor. Subsequently, after the lift down sensor is turned on, the rotating plate drive shaft clutch is released and the rotating cassette drive shaft clutch is engaged and the motor is so driven that the rotating cassette is rotated to be set in the predetermined longitudinal or lateral feeding position where the lateral feed position detecting sensor or the longitudinal feed position detecting sensor is turned on. And after the lateral feed position detecting sensor or the longitudinal feed position detecting sensor is turned on, in case the lift up sensor is not turned on, the rotating plate drive shaft clutch is engaged and the rotating cassette drive shaft clutch is released, thereafter the motor is so driven that the rotating plate is lifted up until the lift up sensor is turned on.

Therefore, in this case, since the rotating cassette and the lift member are not driven at the same timing, both the rotating cassette and the lift member are driven by one motor, whereby the cost of the copying apparatus can be lowered. Moreover, similarly to the first embodiment of the present invention, since the rotating cassette is rotated under the condition that the rotating plate falls down to the bottom position, it is prevented that the sheet on the rotating plate interferes with other means, so that the rotating cassette can be accurately rotated to be set in a desired position.

What is claimed is:

1. In a sheet feeding device including a movable sheet holder formed of a sheet holder case of generally rectangular shape movable in a horizontal direction in which there is provided a rotating plate member having sheets for printing disposed thereon, said rotating plate member being pivotally rotatable in a vertical direction in accordance with the decrement of the printing sheets, said sheet feeding device comprising:

a single driving means for moving said movable sheet holder between a predetermined longitudinal feeding position for feeding a printing sheet to a sheet receiving apparatus in a longitudinal direction of said printing sheet and a predetermined lateral feeding position for feeding a printing sheet to said sheet receiving apparatus in a lateral direction of said printing sheet and for pivotally and vertically rotating a lift member so as to pivotally rotate said rotating plate member up and down;

lift down detecting means for detecting separation of said rotating plate member from a bottom wall of said movable sheet holder;

lift up detecting means for detecting said rotating plate member lifted up to be set in a predetermined sheet feeding position where the printing sheet can be fed out to said sheet receiving apparatus;

lateral feed position detecting means for detecting said movable sheet holder set in said predetermined lateral feeding position;

longitudinal feed position detecting means for detecting said movable sheet holder set in said predetermined longitudinal feeding position;

a first drive shaft clutch means which is provided on a first drive force transmission path for driving said movable sheet holder so as to switch the drive force transmission on said first drive force transmission path on and off;

a second drive shaft clutch means which is provided on a second drive force transmission path for driving said lift member so as to switch the drive force transmission on said second drive force transmission path on and off; and control means for controlling the drive of said driving means in such a manner that, when in the movement operation of said movable sheet holder, if the lift down detecting means is not turned on, said second drive shaft clutch means is engaged and said first drive shaft clutch means is released, thereafter said driving means is so driven that said rotating plate member is lowered down to the bottom wall of said sheet holder case until the lift down detecting means is turned on, and after the lift down detecting means is turned on, said second drive shaft clutch means is released and said first drive shaft clutch means is engaged and said first drive shaft clutch means is engaged and said driving means is so driven that said movable sheet holder is moved to be set in the predetermined longitudinal or lateral feeding position, and after the lateral feed position detecting means is turned on, if said lift up detecting means is not turned on, said second drive shaft clutch means is engaged and said first drive shaft clutch means is released, thereafter said driving means is so driven that said rotating plate member is lifted by the lift member until the lift up detecting means is turned on.

2. The sheet feeding device as defined in claim 1, wherein said rotating plate member can be pivotally rotated around its rotation axis fixed at a lower edge portion thereof on the bottom wall of said sheet holder case.

3. The sheet feeding device as defined in claim 1, wherein said lift member is provided across a side wall of said sheet holder case in a feeding out portion of the printing sheet, wherein a top end portion of said lift member is inserted into a space above the bottom wall of said sheet holder case and under the rotating plate member through an opening portion defined in said side wall of said sheet holder case.

4. The sheet feeding device as defined in claim 3, wherein said lift member is extended from a rotating pivot which is coupled with a driving shaft of said driving means through a pair of first and second engaged gears and through said second drive shaft clutch means.

5. The sheet feeding device as defined in claim 1, wherein said sheet holder case is coupled with said driving means through said first drive shaft clutch means and through a pair of third and fourth gears which are perpendicularly engaged with each other.

6. The sheet feeding device as defined in claim 5, wherein a rotating axis of said driving means is coincident with the axis of said first gear, axis of said first drive shaft clutch means and with the axis of said third gear.

7. The sheet feeding device as defined in claim 1, wherein said lateral feed position detecting means, longitudinal feed position detecting means, lift down detecting means and lift up detecting means can be made by using a contact type switch or photo-interrupter.

8. The sheet feeding device as defined in claim 1, wherein said control means is composed of a microcomputer having its first output port connected to said driving means through an IC driver and having its second and third output ports connected to said second and first drive shaft clutch means through IC drivers, respectively.

* * * * *